United States Patent [19]

Hope

[11] Patent Number: 4,639,021

[45] Date of Patent: Jan. 27, 1987

[54] DOOR LOCK

[76] Inventor: Jimmie L. Hope, 3560 SW. Red Cedar Way, Lake Oswego, Oreg. 97034

[21] Appl. No.: 801,298

[22] Filed: Nov. 25, 1985

[51] Int. Cl.[4] ..... E05C 5/00

[52] U.S. Cl. ..... 292/7; 292/40; 292/69; 70/114

[58] Field of Search ..... 70/114, 115, 116, 149, 70/472; 292/7, 40, 69, 177–180; 188/82.34, 82.3, 82.4, 82.9

[56] References Cited

U.S. PATENT DOCUMENTS

| | | | |
|---|---|---|---|
| 370,331 | 9/1887 | Hamilton . | |
| 601,090 | 3/1898 | Wright . | |
| 2,875,918 | 3/1959 | Baumier | 292/7 X |
| 3,255,618 | 4/1964 | Hermann . | |
| 4,088,353 | 5/1978 | Meyer | 292/40 X |
| 4,227,723 | 10/1980 | Rosell . | |

FOREIGN PATENT DOCUMENTS 2076457 12/1981 United Kingdom .

*Primary Examiner*—Carl D. Friedman
*Attorney, Agent, or Firm*—Eugene D. Farley

[57] ABSTRACT

A door lock for use particularly with sliding patio doors. The lock assembly includes a rotary actuator (door knob) connected to a shaft which drives a crank connected, in turn, to one or more spring-biased bolt rods and operable through the crank to shift the bolt rod to its spring-biased, door-locking position. Stops are positioned to stop the movement of the crank in the locking and unlocking positions of the bolt rod, respectively. Rotary interengaging means such as a pair of meshing gears releasably connect the crank to the shaft assembly. A latch maintains the spring-biased bolt rod releasably in its door-locking position when the gears are meshed. A trip disengages the gear when the bolt rod is in its spring-biased, door-locking position, thereby actuating automatic unlocking of the door.

12 Claims, 12 Drawing Figures

DOOR LOCK

BACKGROUND AND GENERAL STATEMENT OF THE INVENTION

This invention relates to locks for space closures. It relates particularly to locks for sliding patio doors and is described herein with particular reference to that application, although no limitation thereby is intended. The principle of the lock is applicable as well to other types of space closures, such as swinging doors, windows, and containers.

It is the general purpose of the present invention to provide a lock which is versatile in its application to a variety of closure types; which may be installed de novo or as a "piggyback" lock for existing closures; which is tamper proof; which permits partial opening of the closure for ventilation purposes without loss of security; which may be quickly and easily unlocked even under panic conditions and even by the very young or the incapacitated; which does not require a special key for its operation; and which is simple in construction, inexpensive to manufacture, and easily installed.

The lock of my invention providing the aforesaid and other advantages broadly comprises a door knob or other rotary actuator, mounting means for mounting the actuator on the door, and a shaft connected for rotary movement to the actuator.

At least one spring-biased bolt rod is mounted on the door for reciprocation between door-locking and door-unlocking positions. A crank is driven by the actuator and connected to the bolt rod. The crank shifts the bolt rod to its spring-biased, door-locking position.

Stops are positioned to stop the movement of the crank in the locking and unlocking positions of the bolt rod, respectively.

A pair of meshing gears or other rotary interengaging means releasably connects the crank to the shaft assembly. A latch maintains the spring-biased bolt rod releasably in its door-locking position.

Trip means are arranged for disengaging the rotary interengaging means when the bolt rod is in its spring-biased, door-locking position, thereby effectuating automatic unlocking of the door by the means biasing the bolt rod.

THE DRAWINGS

Figure 5:
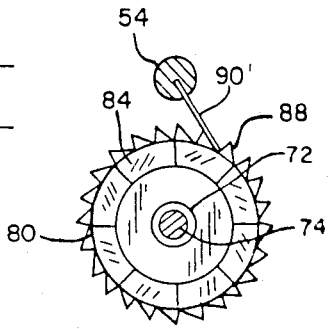
FIG. 5 is a sectional detail view taken along line 5—5 of FIG. 3 and illustrating the application of a pawl and ratchet gear to the lock of my invention.
Figure 6:
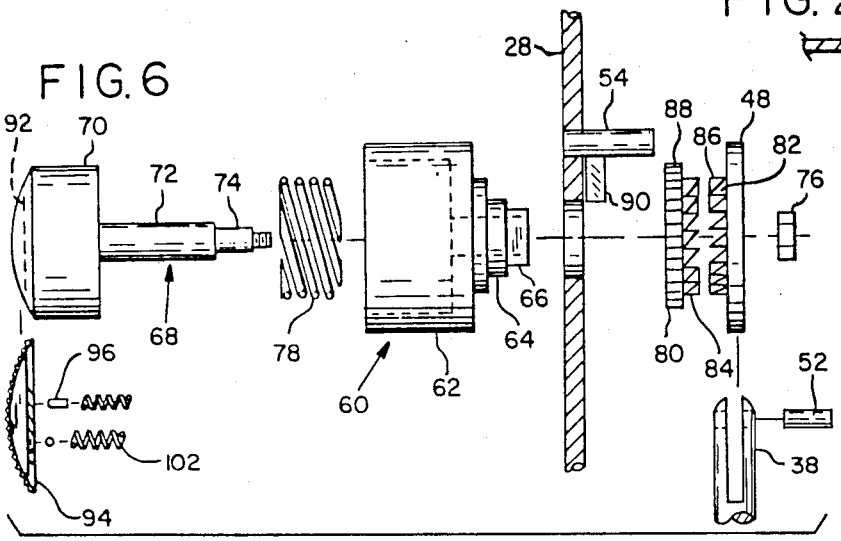
FIG. 6 is an exploded view showing the construction and manner of assembly of the lock of my invention in the embodiment of FIGS. 1–6.
Figure 7:
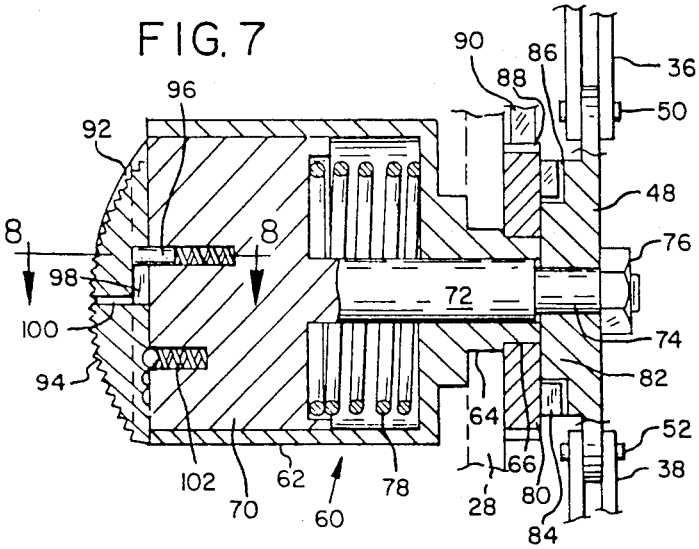
Figure 8:
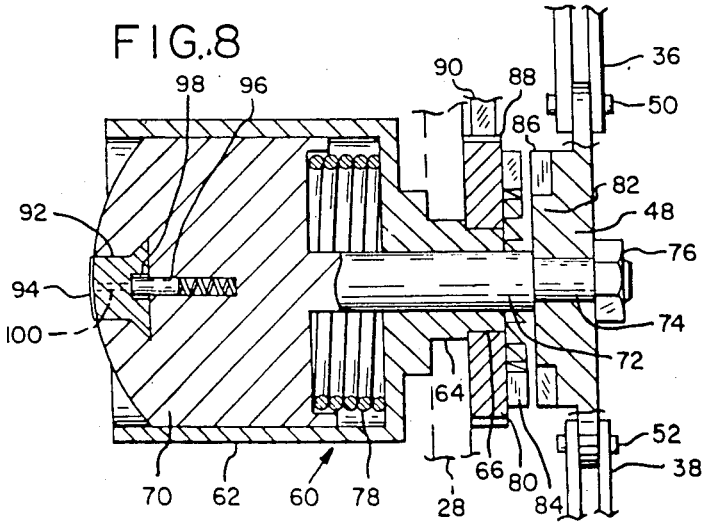

FIGS. 7 and 8 are detail, sectional views illustrating the lock assembly of FIGS. 1–6 including a secondary lock designed to prevent its inadvertent actuation. FIG. 8 is taken at right angles to FIG. 7, as indicated by the arrows 8—8. FIG. 7 represents the primary lock in locked position with the secondary lock in operative position. FIG. 8 illustrates the primary lock in unlocked condition with the secondary lock being inoperative.

Figure 9:
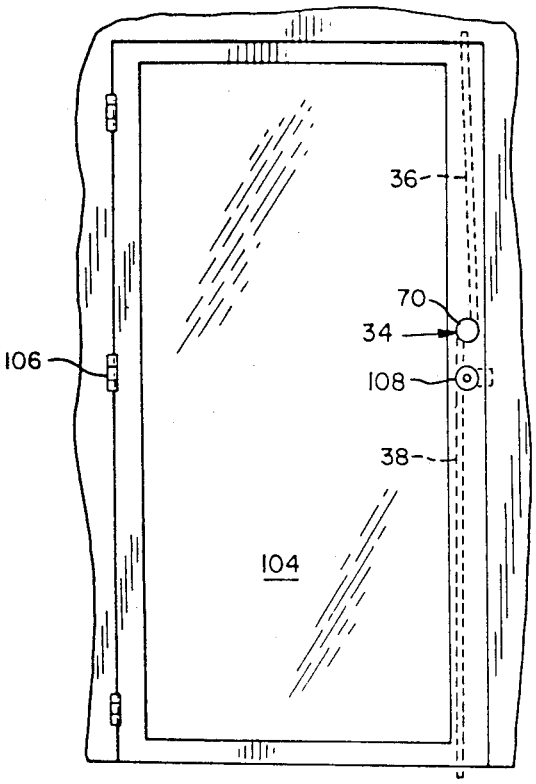

FIG. 9 is a schematic view illustrating the application of the lock assembly of my invention to a door of the class of swinging doors.

Figure 10:
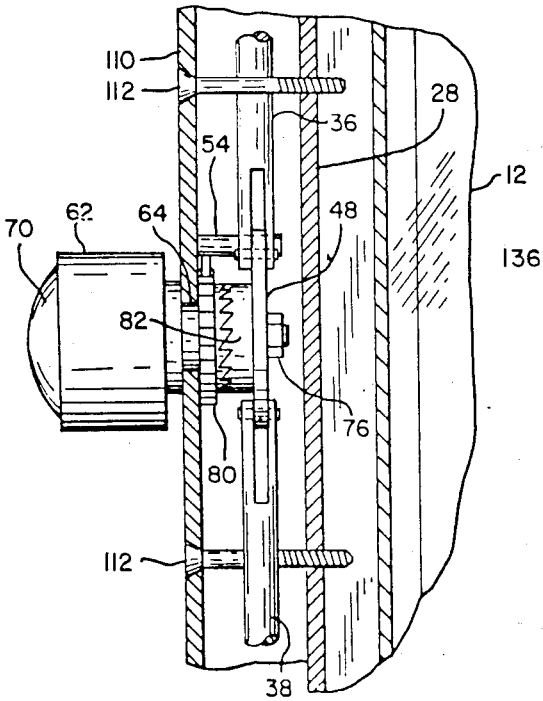

FIG. 10 is a fragmentary sectional view taken longitudinally of the lock assembly applied as an add-on to an existing sliding door structure.

Figure 11:
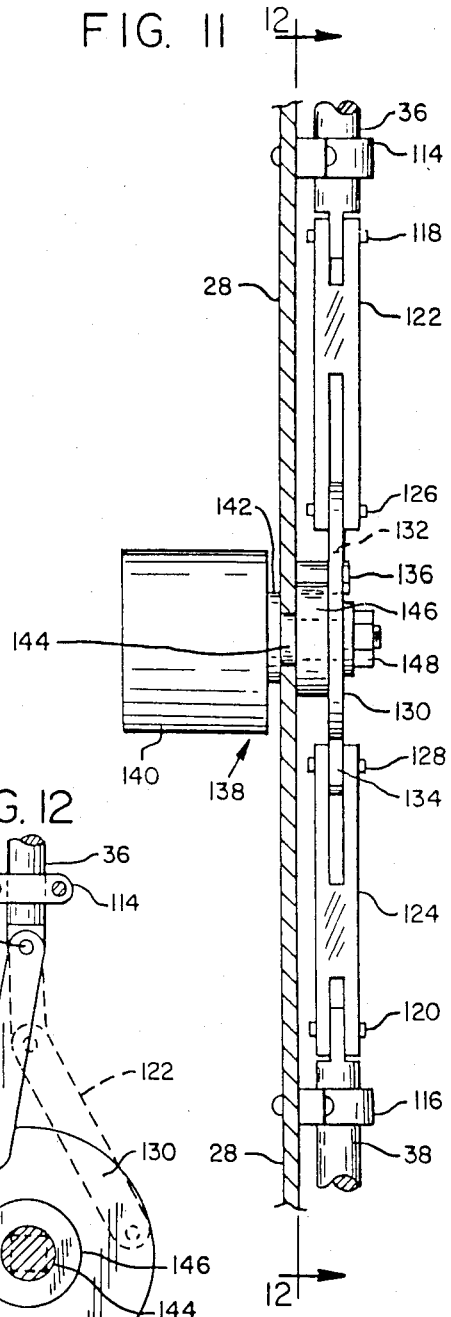
Figure 12:
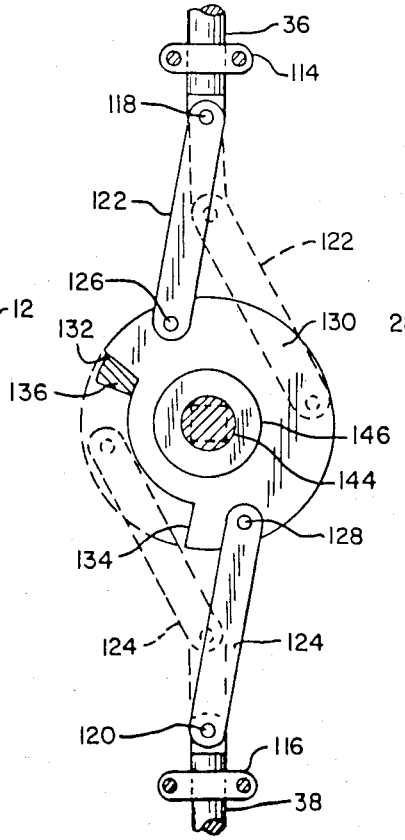

FIG. 11 is a fragmentary sectional view illustrating the lock of my invention in a simplified embodiment, and FIG. 12 is a fragmentary sectional view taken along line 12—12 of FIG. 11.

DESCRIPTION OF SPECIFIC EMBODIMENTS OF THE INVENTION

The Embodiment of FIGS. 1–8

The application of the lock of my invention to an otherwise conventional sliding door assembly is illustrated in FIGS. 1–8.

Figure 1:
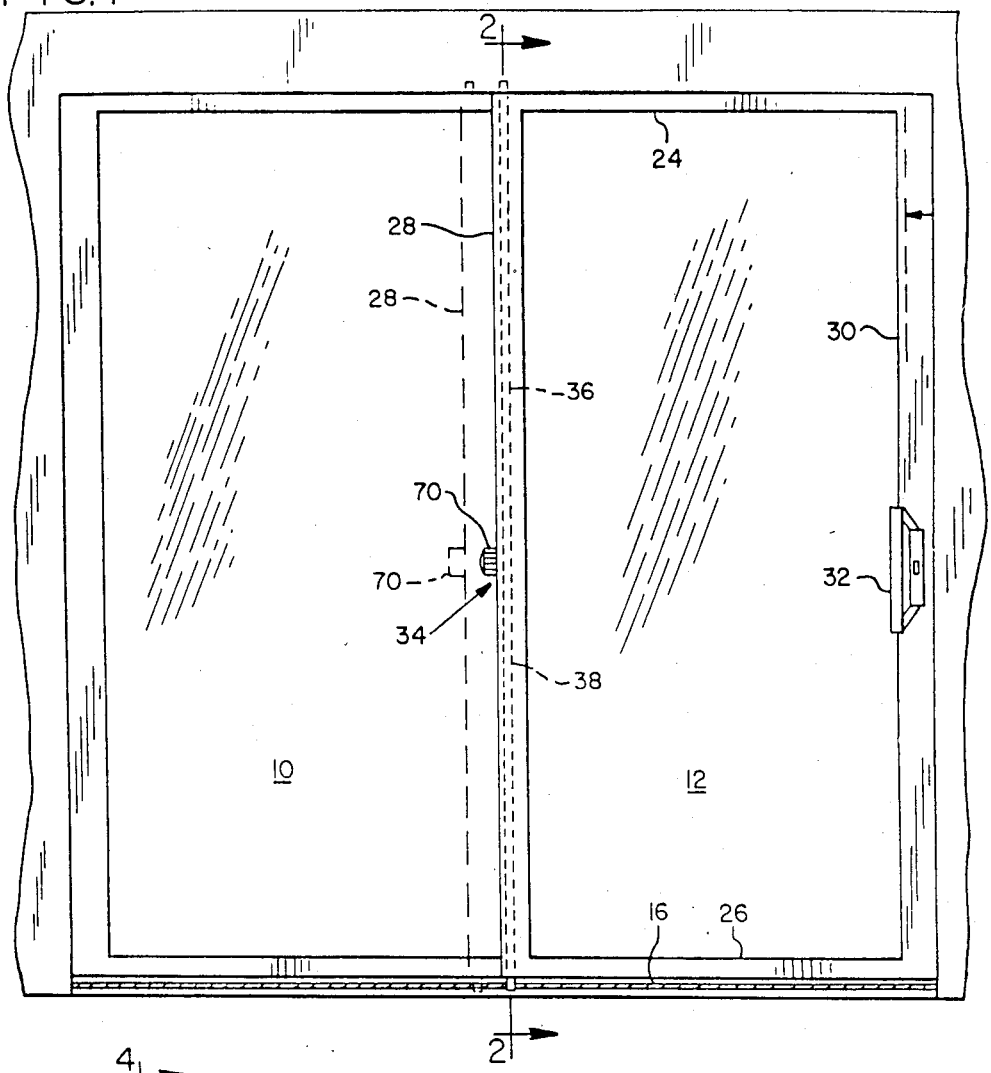
FIG. 1 is a view in front elevation illustrating the manner of installation and application of the lock of my invention as applied to doors of the class of sliding patio doors.
Figure 2:
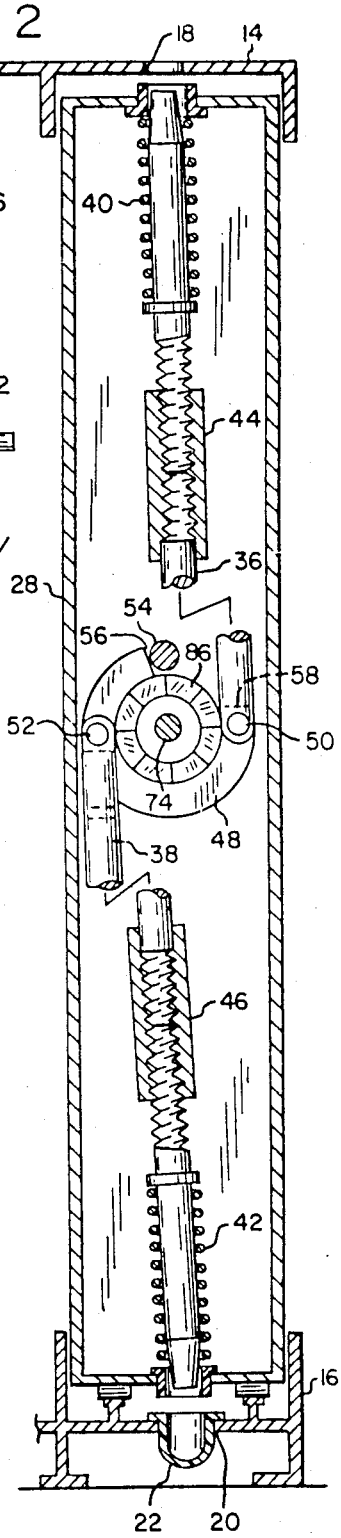
FIG. 2 is a sectional view taken transversely of the lock assembly along line 2—2 of FIG. 1.

As shown in FIGS. 1 and 2, the sliding door assembly comprises in the usual manner a fixed component 10 and a sliding component 12. The sliding component, or door, is mounted slidably in an upper track 14 and a lower track 16. Substantially aligned openings or sockets 18, 20 are provided in the upper and lower tracks, respectively. A plastic cup 22 is pressed into lower opening 20 to provide a seal against the entry of water into the area below track 16.

One or more pairs of openings 18, 20 may be located at spaced intervals along the length of tracks 14, 16 to make possible the adjustment of door 12 in various ventilating positions.

Door 12 is framed by an upper rail 24, a lower rail 26, and a pair of connecting stiles 28, 30. A conventional door latch 32 is mounted on stile 30.

The lock of my invention, illustrated generally at 34 in FIG. 1, preferably is mounted on inner stile 28 in order to make it difficult of access from the outside when door 12 is in its partially opened, ventilating position indicated by the dashed line of FIG. 1.

The locking elements of the lock assembly comprise at least one, preferably a pair of substantially aligned, elongated lock rods 36, 38. The rods are mounted for adjustment between extended, door-locking positions and retracted, door-unlocking positions.

The outer ends of the rods are tapered for easy insertion into opening 18 and socket 22, respectively. They also are fitted with biasing springs 40, 42 arranged to bias the rods normally toward their retracted, door-unlocking positions. Threaded adjustment sleeves 44, 46, one on each rod, make the lengths of the rods adjustable to fit doorways of different heights.

Figure 4:
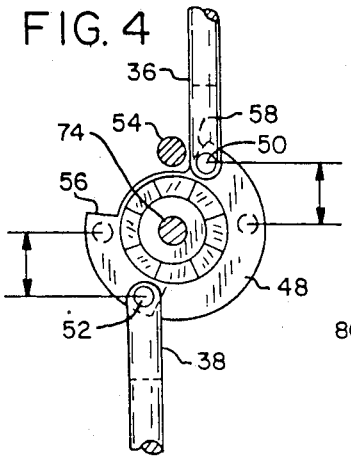
FIG. 4 is a fragmentary sectional view taken along line 4—4 of FIG. 3.

The lock rods are driven to their extended positions by crank means illustrated particularly in FIGS. 2 and 4.

The crank means employed comprises a notched crank plate 48 to which the respective inner ends of the bolt rods are connected pivotally by means of pin and clevis connections, 50, 52.

Stop means are provided for arresting the movement of the bolt rods in their extended and retracted positions.

In the illustrated form of the invention the stop means comprises a post 54 mounted on stile 28 and positioned to contact abutment shoulder 56 of notched crank plate 48 in the retracted position of the rods, FIG. 2, and abutment shoulder 58 of notched crank plate 48 in the extended position of the rods, FIG. 4.

Crank 48 is driven by an actuator assembly the construction and mode of operation of which are illustrated in FIGS. 3–6.

The actuator basically comprises a pair of concentric, relatively-rotatable, releasably-interengageable shafts mounted on a door member, for example stile 28. They are operable in a position of interengagement to drive crank 48 into the spring-biased locking position of bolt rod extension. Upon disengagement of the shafts, the rods are driven into their door unlocking position by the biasing springs associated with the rods.

As illustrated in FIG. 1, the actuator preferably is mounted on the inner edge surface of stile 28. This makes it difficult or impossible of access from the outside of sliding door 12, even when the door is partially open in its venting position.

The outermost of the two concentric shafts is indicated generally at 60. It has a stepped exterior configuration, FIG. 6, to provide a hollow, external actuating knob 62; a bearing segment 64 which penetrates the wall of stile 28; and an end segment 66 which is angular or square in cross section.

The inner shaft which cooperates with outer shaft 60 is indicated generally at 68. It has a domed, button-shaped head 70 dimensioned for reception in hollow knob 62; a central segment 72 which penetrates the balance of hollow outer shaft 60; and an inner segment 74 the terminal portion of which is threaded to receive a nut 76.

A compression spring 78 is seated in hollow knob 62, where it is retained by the skirted portion of button 70.

Rotary interengaging means enable the releasable coupling of the concentric shafts above described to crank plate 48. In the illustrated form of the invention, the rotary interengaging means employed comprise a pair of meshing gears, preferably unidirectional, saw tooth gears. One is mounted on the inner end 66 of shaft 60 for rotation therewith. The other is mounted on the inner end 74 of shaft 68, being freely rotatable thereon.

To this end there is provided a gear 80 having a squared or angled central opening which mounts operatively on the squared or angled end 66 of shaft 60. Gear 80 is provided with teeth 84 which, for ease of engagement, have a directional, saw tooth design.

Gear 80 also is provided with peripheral ratchet teeth 88, the purpose of which will appear hereinafter.

Gear 82 is mounted for free rotation on end segment 74 of shaft 68. It is provided with gear teeth, preferably unidirectional, saw tooth type gear teeth 86. These are designed to mesh with teeth 84 on gear 80.

As indicated in FIGS. 7 and 8, gear 82 may be molded or cast integrally with crank plate 48. Both of these components, as well as gear 80, preferably are fabricated from an inexpensive, durable plastic material such as Nylon.

Latch means is provided for maintaining the spring-biased bolt rods 36, 38 releasably in their door-locking positions.

Figure 3:
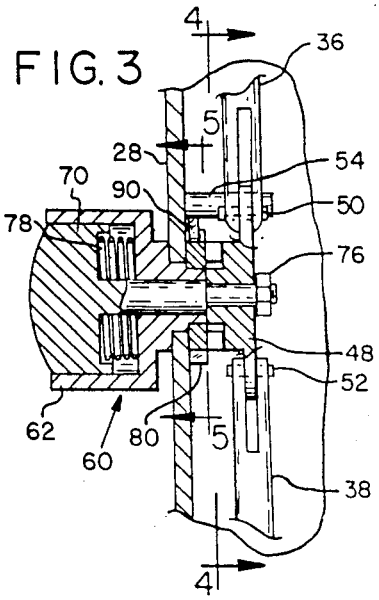
FIG. 3 is a fragmentary view in vertical section illustrating the lock in its assembled condition.

As seen best in FIGS. 3 and 5, the latch means comprises the ratchet provided by teeth 88 on gear 80 cooperating with a pawl 90, preferably of spring steel, and preferably mounted on stop 54. The pawl and ratchet teeth are operable to maintain the spring-biased bolt rods releasably in a door-locking position.

The button-actuated, spring-pressed, concentric shaft structure described above provides a trip which is operative to disengage gears 80, 82 when the bolt rods are in their spring-biased, door-locking position. When such disengagement occurs, the biasing springs 40, 42 associated with the bolt rods retract the rods, thereby unlocking the door.

To secure the door further and prevent its inadvertent unlocking by operation of the trip mechanism, the secondary locking device illustrated in FIGS. 7 and 8 may be included in the assembly of my invention. The secondary lock prevents inadvertent depression of the button head 70 of shaft 68 and thus prevents tripping of the lock.

To this end, the head 70 of shaft 78 is formed with a guideway 92. A slide 94 is mounted for sliding movement within the guideway. A spring pressed pin 96 works in a slot 98 in the bottom of the slide. An access opening 100 communicates with the slot.

Slide 94 may be shifted between a retracted position, wherein its margins register with the margins of head 70 (FIG. 8), and an advanced position wherein it overlaps the margins of the head (FIG. 7). In its retracted position it permits tripping of the lock. In its overlapped position, it prevents tripping. It is maintained in its desired position by means of a spring-pressed detent 102. It may be removed, for cleaning or repair, by inserting a probe in access opening 100 and depressing spring-pressed pin 96.

The Embodiment of FIG. 9

The application of the lock of my invention to a swinging-type door is illustrated in FIG. 9.

The door 104 is mounted in the doorway by hinges 106 in the usual manner. It is provided with the usual locking latch 108.

The herein described lock may be applied to the door by mounting bolt rods 36, 38 on the door in the manner described above with reference to the embodiment of FIGS. 1–6. Suitable sockets are provided in the door framing members for reception of the ends of the rods when the door is in closed position. The rods may be coupled to, and actuated by, the actuating mechanism 34 in the described manner.

The Embodiment of FIG. 10

The forms of the invention described above presume factory installation of the lock of my invention. It is a feature of the invention, however, that it may be installed easily on a conventional sliding or other door as an "add-on" or "piggyback" installation, without disfiguring the door or interfering with its operation. The manner in which this is accomplished is illustrated in FIG. 10.

In this embodiment, the components of the lock are mounted in a suitable channel or other type of housing 110. The resulting assembly then is mounted on stile 28 by means of self-threading screws 112, or other suitable attaching means. Thus mounted, it operates in the manner above described.

The Embodiment of FIGS. 11 and 12

The embodiment of FIGS. 11 and 12 applies the principle of the slotted crank plate 48 in a structure of simplified design employing a minimum of parts. It also illustrates a structure in which bolt rods 36, 38 are maintained perfectly aligned with each other and with their cooperating locking sockets.

For the latter purpose, bolt rods 36, 38 are mounted in guides 114, 116 mounted on an inner surface of stile 28. The inner ends of the rods are connected pivotally by pins 118, 120 respectively to the outer ends of links 122, 124. The inner ends of links 122, 124 are connected pivotally by pins 126, 128 to crank plate 130.

Crank plate 130 is analogous in structure and function to crank plate 48 of the previously described embodiments. It is formed with a peripheral slot providing abutments 132, 134. These cooperate with a stop 136 in determining the position of the crank plate, and hence the condition of door locking or unlocking by means of bolt rods 36, 38.

The drive for crank plate 130 comprises the segmented shaft indicated generally at 138, FIG. 11.

Segmented shaft 138 comprises an outer knurled knob 140, a shoulder segment 142 and a bearing segment 144.

Bearing segment 144 penetrates stile 28 and crank plate 130. It mounts a spacer 146 which may be formed integrally with crank plate 130.

Bearing segment 144 has a square or angular cross section which mates with an opening of corresponding cross section in crank plate 130. It also has an outer terminal portion of reduced cross section which is threaded to mount a securing nut 148.

Stop 136 is so located that it engages abutment 132 in the full line, over-center, door-locking position of FIG. 12. It engages abutment 134 in the dashed line, door-unlocking position of that figure.

Operation

The operation of the embodiments of FIGS. 1–10 inclusive is as follows:

To lock the door, actuating knob 62 is turned counterclockwise to its FIG. 4 position with abutment 58 on the crank plate engaged by stop 54. This extends the bolt rods 36, 38 into their associated sockets in the door framing members, against the force of biasing springs 40 and 42.

Actuation of crank plate 48 is accomplished through the agency of the coaxial shaft assemblies, FIGS. 6, 7 and 8. With gears 80, 82 intermeshed, turning knob 62 rotates shaft 60 of which the knob is an integral component. Rotation of shaft 60 rotates crank plate 48 through the agency of the meshing gears. During this rotation, ratchet gear 88 turns freely.

Stop 54 arrests the rotation of crank plate 48 in a position which is not past dead center. It is maintained in this position by pawl 90 acting against ratchet gear 88.

When it is desired to unlock the door, slide detent 94 is retracted (if locked), and the head 70 of shaft 68 pushed inwardly, against the force exerted by spring 78, as illustrated in FIG. 8. This moves shaft 68, of which head 70 is an integral part, to the right, as viewed in FIG. 8, separating gears 80, 82. Crank plate 48 now can spin freely on shaft segment 74, permitting springs 40, 42 to retract bolt rods 36, 38 to their FIG. 2 position, unlocking the door.

If it is desired to open the door a limited amount while still maintaining it in locked condition, the door may be moved to the dashed line position of FIG. 1 wherein the bolt rods engage a second pair of sockets in the door framing member.

It is to be noted that positioning the lock assembly 34 on inner stile 28, and particularly on the edge face thereof, makes it difficult if not impossible for an interloper to operate the lock when the door is in its partly open, ventilating position. The lock actuator is remote from the door opening. Also, the secondary lock comprising slide 94 provides added security, since, when it is in its working position, it prevents actuation of the lock release.

The operation of the lock of FIGS. 11 and 12 is as follows:

To lock the door, knob 140 is turned counterclockwise. This rotates the integral shaft 144 and turns crank plate 130, also in counterclockwise direction.

Rotation of the crank plate is continued until abutment 132 strikes against stop 136. This locates the lock assembly in the full line position of FIG. 12, with bolt rods 36, 38 fully extended and with the crank plate slightly over-center. In view of its over-center position, the rods automatically are retained in their extended, door-locking position by the action of the biasing springs 40, 42.

To unlock the door, the actuating knob 140 and associated shaft segment 144 are turned clockwise. Force need be applied only until crank plate 130 is moved past dead center in the opposite direction. Thereupon the biasing springs 40, 42 retract the bolt rods and rotate crank plate 130 until abutment 134 strikes stop 136. This locates the crank plate in its dashed line position of FIG. 12, wherein the bolt rods 36, 38 are withdrawn from the associated sockets, permitting opening of the door.

Having thus described in detail preferred embodiments of my invention, it will be apparent to those skilled in the art that many physical changes may be made in the apparatus without altering the inventive concepts and principles embodied therein. The present embodiments therefore are to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A door lock comprising:

(a) a rotary actuator, (b) means for mounting the actuator on the door, (c) a shaft assembly connected for rotary movement to the actuator, (d) at least one spring-biased bolt rod mounted on the door for reciprocation between door-locking and door-unlocking positions, (e) a crank connected to the bolt rod and operable to shift the bolt rod to its spring-biased door-locking position, (f) stop means positioned to stop the movement of the crank in the locking and unlocking positions of the bolt rod, (g) rotary interengaging means releasably connecting the crank to the shaft assembly, (h) a latch operable to maintain the spring-biased bolt rod releasably in its door-locking position, and (i) trip means arranged for disengaging the rotary interengaging means when the bolt rod is in its spring-biased, door-locking position, thereby actuating automatic unlocking of the door.

2. The door lock of claim 1 wherein the crank comprises a peripherally-notched, shouldered, crank plate and wherein the stop means comprise the shoulders on the crank plate.

3. The door lock of claim 1 wherein the rotary interengaging means comprises meshing gears.

4. The door lock of claim 1 wherein the rotary interengaging means comprise unidirectional meshing saw tooth gears.

5. The door lock of claim 1 wherein the latch means comprises a pawl and ratchet.

6. The door lock of claim 1 wherein the rotary interengaging means comprises a pair of intermeshing gears and wherein the shaft assembly comprises two relatively rotatable shafts, the inner shaft mounting one of the gears and the other shaft mounting the other.

7. The door lock of claim 6 wherein said one of the shafts is integral with the crank.

8. The door lock of claim 6 wherein the latch means comprises a ratchet, wherein one of the gears is mounted on the crank and wherein the ratchet includes a ratchet gear mounted on said other of the gears.

9. The door lock of claim 1 wherein the rotary interengaging means comprise a pair of meshing gears and the shaft assembly comprises a pair of concentric relatively moveable shafts, one of the shafts mounting one of the gears and the other of the shafts mounting the other of the gears, and including trip means connected to one of the gears for disengaging the pair of gears.

10. The lock of claim 9 wherein the trip means comprises a spring-pressed button mounted on the outer end of said one of the shafts.

11. The lock of claim 9 wherein the trip means comprises a spring-pressed button mounted on the outer end of said one of the shafts and including also lock means mounted on the springpressed button for insuring against its inadvertent actuation.

12. The lock of claim 11 wherein the button lock comprises a sliding detent.

* * * * *